US006438935B2

(12) United States Patent
Klaus et al.

(10) Patent No.: US 6,438,935 B2
(45) Date of Patent: Aug. 27, 2002

(54) PROCESS AND APPARATUS FOR THE MANUFACTURE OF COMPOSITE FIBROUS STAND COMPRISING GLASS FIBERS

(75) Inventors: Michaela Klaus, Hasloch; Reinhart Dosch, Wertheim; Hans Georg Mann, Krenzwertheim, all of (DE)

(73) Assignee: Schuller GmbH, Wertheim (DE)

( * ) Notice: Subject to any disclaimer, the term of this patent is extended or adjusted under 35 U.S.C. 154(b) by 0 days.

(21) Appl. No.: 09/814,870

(22) Filed: Mar. 23, 2001

Related U.S. Application Data

(62) Division of application No. 09/544,217, filed on Apr. 7, 2000.

(30) Foreign Application Priority Data

Apr. 9, 1999 (DE) ..... 199 15 955

(51) Int. Cl.[7] ..... D01H 4/08
(52) U.S. Cl. ..... 57/408; 57/404
(58) Field of Search ..... 57/400, 401, 403, 57/404, 405, 406, 407, 408, 409, 410, 411, 412, 413, 414, 415, 416, 417

(56) References Cited

U.S. PATENT DOCUMENTS 4,433,535 A 2/1984 Darrichard et al.
4,698,962 A * 10/1987 Artzt et al. ..... 57/409
4,863,502 A * 9/1989 Schlachter ..... 65/4.3
5,425,796 A 6/1995 Loubinoux et al.

FOREIGN PATENT DOCUMENTS

| | | | |
|---|---|---|---|
| DE | 3634904 A1 | | 4/1988 |
| DE | 3634904 A1 | * | 4/1988 |
| DE | 3151968 | | 8/1992 |
| DE | 19800725 A1 | | 7/1999 |
| EP | 0292409 | | 11/1988 |
| EP | 0636717 | | 2/1995 |
| EP | 0616055 B1 | | 8/1997 |

* cited by examiner

*Primary Examiner*—Danny Worrell
*Assistant Examiner*—Shaun R Hurley
(74) *Attorney, Agent, or Firm*—Burns, Doane, Swecker, & Mathis, LLP

(57) ABSTRACT

A process and apparatus are provided for the manufacture of a composite fibrous strand comprising glass fibers. Glass fibers and an additive fibrous material (e.g., thermoplastic polymeric fibers) are each introduced separately into a substantially rotationally symmetric zone that is closed circumferentially except for a longitudinal introduction locale. The glass fibers and the fibers of the additive fibrous material are subjected to a vortex to form a homogeneous composite fibrous strand. Good admixture of the fibrous components is made possible thereby facilitating the ultimate production of composite articles wherein the glass fibers are disposed as reinforcement in a highly uniform manner. Such homogeneity and uniformity provides improved mechanical properties to the end user.

6 Claims, 1 Drawing Sheet

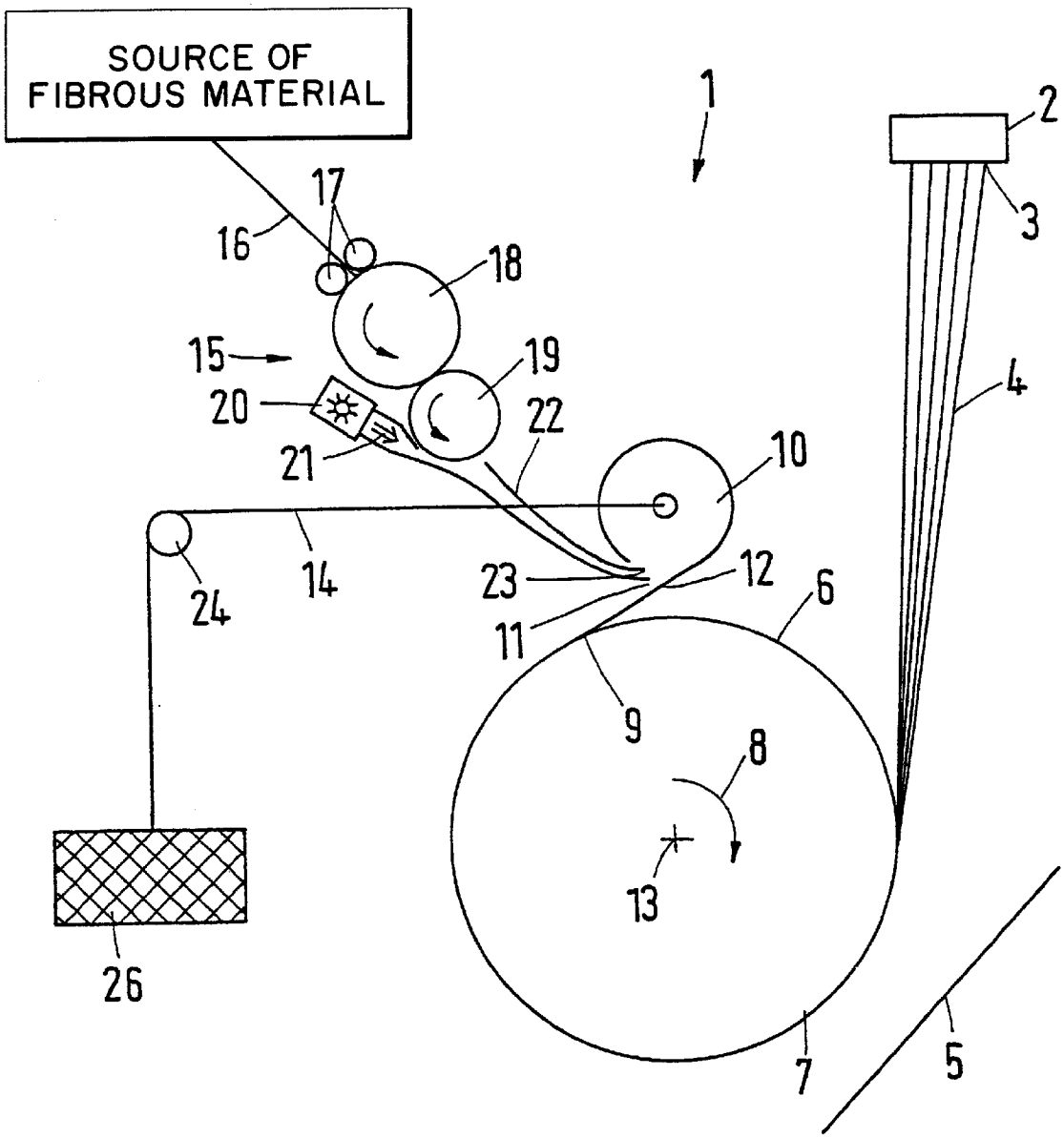
SOURCE OF
FIBROUS MATERIAL
1
2
3
4
5
6
7
8
9
10
11
12
13
14
15
16
17
18
19
20
21
22
23
24
26

PROCESS AND APPARATUS FOR THE MANUFACTURE OF COMPOSITE FIBROUS STAND COMPRISING GLASS FIBERS

This application is a divisional, of Application Ser. No. 09/544,217, filed Apr. 7, 2000.

The invention concerns a process and apparatus for the manufacture of a composite fibrous strand of glass fibers and at least one additive fibrous material other than glass fibers. The apparatus possesses a rotating pick-up surface, a fiber lifting arrangement, a spinning funnel which in its circumferential wall possesses a longitudinal feed connection with a first feed path for glass fibers, a removal opening, a removal device, and a supply device for the additive fibrous material. In addition, the invention concerns a process for the manufacture of a composite fibrous strand of glass fibers and at least one additive fibrous material, and in which process a multiplicity of glass fibers are conducted into a substantially rotationally symmetric zone which is closed in at least its circumferential direction except for the feed connection, in which zone the fibers are subjected to a vortex from which the resulting combined fibers are withdrawn as a fiber composite. Finally, the invention concerns a fiber composite of staple fibers comprising glass fibers and additive material fibers such as plastic fibers (e.g., synthetic polymeric fibers).

BACKGROUND OF THE INVENTION

An apparatus and a process of this general type is disclosed in German unexamined patent application No. 3634904 A1. In that patent disclosure molten glass emerges from nozzles on the underside of glass melting tanks. The molten drops which are thus formed are pulled into glass fibers as the drops migrate to a steeply slanted plane surface, are passed to the surface of a pick-up drum, and are subsequently removed from the drum. Before reaching a full circumferential winding on the drum, the fibers are raised from the drum surface by a lifting arrangement. The fibers next with the aid of a transporting air stream from the drum surface are guided into a spinning funnel wherein the fibers are simultaneously injected and entwined. The glass fiber composite so produced is extracted from an exit opening of the spinning funnel by a withdrawal apparatus. In addition an introduction device for fibers of another material is possible, which additionally introduces fibers of synthetic material to the drum surface. Alternatively, the insertion of the synthetic fibers can take place at the pick-up point for the glass fibers, that is in between the lift from the drum and the entry into the spinning funnel. The fibers of both types always are intermixed prior to introduction into the spinning funnel. This kind of manufacture permits the production of mixed fiber composites from glass fibers and an additive fibrous material, preferably plastic, such as a polyamide. In any event, it has been determined that these fibrous composites do not exhibit a satisfactory homogenous character. Nests of glass fibers and nests of the additive fibrous materials, each in their respective original states, are found to occur in groupings within the fiber composite. Nevertheless, this product is acceptable for many end uses and the tensile strength tends to be maintained.

European Patent No. 0616055 B1 discloses an apparatus and a process for the production of a composite yarn, in which endless glass filaments are combined with continuous filaments of a thermoplastic polymeric material. In this case, the individual glass filaments are led over a coating arrangement. The pretreated polymeric fibers are then, in common with the glass fibers, conducted over a tension roll and subsequently are spun. It should be pointed out that the fiber composite, when observed in cross-section is relatively non-homogenous.

SUMMARY OF THE INVENTION

An apparatus is provided for forming a composite fibrous strand comprising glass fibers and at least one additive fibrous material having enhanced homogeneity, the apparatus comprising a rotating surface for transporting the glass fibers; a device for lifting the glass fibers from the rotating surface; a spinning funnel having a circumferential wall having a longitudinal opening into which glass fibers are introduced along a first feed path, the spinning funnel having and exit opening at an end thereof for removing product; a feeding system defining a second feed path for introducing into the spinning funnel the additive fibrous material, the second feed path being separate from the first feed path when introduced into the spinning funnel; and a device for removing the resulting composite fibrous material formed in the spinning funnel.

A process is provided for the manufacture of composite fibrous strand wherein glass fibers and an additive fibrous material are introduced separately into a substantially rotationally symmetric zone with the zone being closed circumferentially except for a longitudinal introduction locale wherein the glass fibers and the additive fibers are subjected to a vortex to form a composite fibrous strand of enhanced homogeneity, and withdrawing the resulting composite fibrous strand from the zone.

A composite fiber strand formed from staple fibers comprising a homogeneous admixture of glass fibers and at least one additive fibrous material in a weight ratio of 10:90 to 99:1.

The present invention has the objective of making of a hybrid yarn which is better suited for use as uniform fibrous material during the formation of a flat preform laminate.

This objective is achieved by an apparatus as described earlier wherein the supply device possesses a second feed path, which is separated from the said first feed path at the circumferential wall of the spinning funnel. With this equipment, it is possible to create a fiber composite that is homogeneous.

A previously known apparatus is modified and is used for the manufacture of the composite fibrous strand. The apparatus is modified so that a different feed location is provided for the additive fibrous material. In the past the premise was that the two fiber types were to be already intermixed prior to their introduction into the spinning funnel. For instance, on the drum pick-up surface the glass fibers and the additive fiber were to be already mixed thereby providing a mixed material which is introduced into the spinning funnel. It now has been found through empirical research that this premise was not accurate when optimum results are sought. Possibly the difficulty lies in the fact that the plastic fibers cannot penetrate the air stream layer which picks up the glass fibers on the drum surface and in which the glass fibers are caused to float. Giving credence to this viewpoint in the previously known procedure a full admixture between the glass fibers and the plastic fibers does not come about. When, however, the second feed path is employed as in the present invention, in order to feed the additive fibrous material into the spinning funnel, there is no need that the mix has already occurred prior to introduction such as on the drum surface. The mixing is now brought about entirely in the spinning funnel in a homogeneous manner. Besides achieving homogeneity, this procedure also has the advantage that the danger of contamination in the immediate environment by the additive fibrous material is considerably less. The input air stream carrying the additive fibrous material also lends itself more easily to adjustment. Moreover, a flat material which is produced from the improved homogenous composite fibrous strand just described, can be worked using a lesser press time so that a finished composite article can be made more quickly and at a lower cost. With the greater homogeneity a favorable notch impact strength, structural strength and the like can be obtained as well as an improved flexural strength. By that is meant, a mechanical strength in addition to mere tensile strength is made possible when using the hybrid yarn when forming flat, preformed, or molded parts. The glass fibers, in the press procedures consolidate more easily into the matrix of the additive fibrous materials.

Advantageously, the respective first and second feedpaths run through the feed connection and are separated from one another by a partition.

In relation to a conventional apparatus, only a small modification is necessary. Basically, it would be sufficient, simply to insert a small piece of sheet metal in the feed opening on the underside of which the glass fiber stream would flow in and on the upper side the stream of additive fibrous material would flow. The rotary turbulence ensues in the spinning funnel where the corresponding vortexing takes place without being disturbed by other openings in the circumferential spinning funnel wall.

Advantageously, the second feed path is separate within the feed connection or ends in common therewith. With this the inflow of additive fibrous material can be better regulated. The fibrous material now in the common feed connection is then directed to the spinning funnel. In accordance with the concept of the present invention the dissimilar fiber types are not intermixed prior to their introduction into the spinning funnel.

Advantageously, the second feed path possesses its own air supply. The additive fibrous material is then pneumatically conveyed into the spinning funnel. This extra air assures that the additive fibrous material can mix itself with the glass fibers. Advantageously, the air flow of the air supply is controllably adjustable. Thereby the operator is provided with yet another means of altering the build-up of the fibrous composite. It is thereby possible to cause the air flow of the air supply to advantageously conform to the air flow which is produced by the pick-up drum. This also makes possible various machine adjustments, for instance, the speed of production.

Favorably, the feed apparatus for the additive fibrous material possesses a disassociation device which separates the fibers apart. The additive fibrous material can be brought to the disassociation device in a form that is more easily manipulated, for instance as a fiber band or as a fleece or unwoven material. At that point the fibers of the additive fibrous material will be separated, one from the other. Then, only the single fibers, or groups of few fibers, are injected into the second feed path to the spinning funnel.

Advantageously, the disassociation device is served with an air flow directed into the second feed path. This air flow then has three purposes. First, it takes the additive fibrous material away from the disassociation device, second it cleans so that the product from remains of uniform good quality, and third it transports the fibers of the additive material to the spinning funnel. All of this assures homogenization.

In an advantageous manner, the first feed path is placed more closely to the outer wall of the spinning funnel than is the second feed path. This simplifies the construction. The spinning funnel, or a diversion blade, can remain relatively close to the drum surface, so that the pick-up air stream can be diverted to subject the fibers to a vortex.

The objective of the invention is achieved by a process of the type described in the introductory passages of this description, in that the additive fibrous material while separated from the glass fibers is guided into the space of the spinning funnel through a longitudinal feed opening in the circumferential wall of the spinning funnel.

Only in the space within the spinning funnel is the mixing and vortexing action of the two fibrous materials carried out. Surprisingly, this contributes to the homogeneity of the fibrous composite.

Advantageously, the additive fibrous material is conducted into the spinning funnel space through the same longitudinal feed connection, but is separately compartmentalized from the glass fibers. In this way, the most favorable conditions for the formation of the vortex are maintained. The mixing zone has but one disturbance location in its circumferential wall. The two materials can thus be brought together in closer contact before entering the vortex.

The objective of the invention will be achieved through the formation of a fibrous composite of the type described in the opening passages of this description in which the glass fibers and the additive material fibers are mixed to a high degree of homogeneity when observed across the cross-section of the fibrous composite.

This manufacturing process and apparatus as described make possible the production of the desired homogeneous composite fibrous strand, i.e., a hybrid yarn. The fibrous composite has the advantage that because of its homogeneity a greater loading factor is made possible. In particular, the danger is drastically reduced that nests of glass fibers can produce localized points for overload which sooner or later can lead to imperfections within the fibrous composite. The hybrid fibrous strand can be characterized by a homogenous mixture of the fiber components. The thermoplastic additive fibrous materials can serve as matrix components for flat products such as a prepreg made from hybrid yarns. Alternatively, or in addition to the matrix fibers, additional organic or inorganic fibrous materials can be included. As an example, natural organic fibrous materials can be utilized. The homogenous mix between glass fibers and matrix fibers can be subsequently transformed to flat products when subjected to heat and pressure. This action results in a favorable and uniform embedding of the reinforcing glass fibers in the softened melt of the matrix. Out of this procedure better mechanical characteristics of the end products arise, such as tensile strength, high flexural stress, and improved notch impact strength.

In an advantageous way, the glass fibers and the additive fibrous material are generally aligned in the lineal direction of the composite fibrous strand. This results in a generally high structural strength. The direction of the fibers is not necessarily exactly parallel. Additionally, there can exist substantial looping and twisting. There is, however, no construction in which is found a core of one type of fiber or a mantle or cover of another type in which the covering fibers run primarily circumferentially. See, for instance, the different product formed in accordance with the teachings of German Offenlegungsschrift No. 19800725.

In an advantageous manner, the weight ratio of glass fibers to additive material fibers lies in the range of 10:90 up to 99:1. In other words, the fibrous composite, which can also be termed a hybrid yarn, has a composition of 10 to 99% glass fibers and 90 to 1% additive fibrous material, the additive material being preferably organic polymeric fibers that are capable of being melt spun. Particularly advantageous here are thermoplastic polymeric fibers that can serve as a matrix. Favorably the ratio lies in the range of 10:90 to 90:10.

Accordingly, desirable mechanical properties are made possible particularly in the area of flexural strength with a good capacity to withstand thermal influences. For other applications, the possibility exists to employ fibrous starting materials that are natural organic fibers. An example of this is hemp, alone or in combination with plastic polymeric fibers.

Advantageously, the glass fibers are formed from C-glass and/or E-glass. Fibers of these compositions can be readily spun.

In an advantageous way, the glass fibers possess a diameter in the range of 2 to 25 $\mu$m, and preferably, 7 to 17 $\mu$m. Fibers with diameters in these ranges have been found to unite well with the additive fibrous material to form the composite fibrous strand.

Advantageously, the glass fibers as well as the fibers of the additive fibrous material fibers are staple fibers. Such staple fibers have a limited length. For this reason, they are particularly amenable to good intermixture and spinning.

Advantageously, the fibers of the additive fibrous material exhibit a length of more than about 10 mm, and preferably in the range of approximately, 40 to 80 mm. This length has been found to be excellent for admixture and spinning. A fiber length of at least about 10 mm is necessary, in order to form a quality composite fibrous strand.

Preferably, the additive fibrous materials are formed of polymeric fibers. Any spinnable organic fibers can be utilized.

Advantageously, the resulting composite fibrous strand exhibits a titer in the range of approximately 20 to 5000 tex (i.e., a denier of 180 to 45,000), and preferably in the range of approximately 200 to 2000 tex (i.e. a denier of 1,800 to 18,000).

DESCRIPTION OF THE DRAWING

The drawing illustrates a schematic presentation of an apparatus capable of carrying out the process of the present invention wherein a homogenous composite fibrous strand is formed.

DESCRIPTION OF PREFERRED EMBODIMENT

The description of a preferred embodiment of the present invention follows with reference being made to the drawing. It should be understood that the invention is not limited to the specific details set forth in the example. In the drawing, an apparatus 1, for the manufacture of the composite fibrous strand is presented, while showing only the essential features. A glass melting tank 2 with melt extrusion orifices 3 is shown. Melted glass emerges in the shape of a plurality fibers 4 or threads through orifices 3. These fibers are produced so that molten glass coming out of the nozzles in the form of droplets fall upon a metal sheet guide surface 5. When the discrete staple fibers formed from these drops slide further on the sheet metal surface 5, they come in contact with the surface 6 of a pick-up drum 7. The pick-up drum 7 rotates in the direction of the arrow 8 at an appropriate speed. A flow of air impinges on the surface 6 at the area where the glass fibers are withdrawn from pick-up drum 7. This surface 6 carries the fibers 4 until the point of withdrawal. The fiber transport on the drum 7 can be enhanced by a thin sheet of oil on surface 6.

The glass fibers 4, are lifted from the pick-up drum 7 with the use of removal device 9, for instance a scraper blade, and are conducted to spinning funnel 10 through feed connection 11. Another scraper blade 12 of the spinning funnel 10 extends more or less without transition to scraper blade 9. The spinning funnel 10 has a rotational symmetrical shape except for the longitudinal, feed connection opening adjacent the scraper blade. Its axis is essentially parallel to the axis 13 of the pick-up drum 7. In accordance with this arrangement, the above-mentioned flow of air is now peeled off from the surface 6 of the, pick-up drum 7 by the scraper blade 9. This air or drum-wind can now enter the spinning funnel 10 and there reinforce a vortex involving the glass fibers. The fibers inside the spinning funnel 10 generally are present as individual staple fibers. The individual glass fibers 4 are substantially disassociated somewhere on the way between the pick-up drum 7 and the spinning funnel 10, or else within the spinning funnel itself. On a front side of the spinning funnel 10 (perpendicular to the drawing plane and at the small end of the funnel), the fiber composite can be withdrawn as a strand.

Furthermore, the apparatus exhibits another distinct feeding device 15 (i.e., a feeding system) for an additive fibrous material 16. The additive material 16 can be plastic or polymeric fibers (for instance, of polyamide, polypropylene, or polyester) which are incorporated within the resulting composite fibrous strand 14. In the specific embodiment being described, the additive fibrous material 16 is provided in the form of a continuous band of staple fibers. Also it is possible, that the additive fibrous material 16 be fed in the form of a fleece, unwoven, or a flock of staple fibers.

The disassociation device 15 includes feed rolls 17 to introduce the additive fibrous material into the feeding system. Rolls 18 and 19 are provided which serve to separate the additive fibrous material 16 into individual staple fibers. One can utilize counter-turning rollers or a carding device to achieve this disassociation. The upper roller 18 is association with roller 19 pulls apart single fibers or small fiber groups from the additive fibrous material 16. A further disassociation of fibers occurs on the lower roll 19. The lower roll 19 is subjected to an air flow from a blower 20, which serves several functions. First, the air flow 21 blows the fibers away from the lower roll 19. Second, the air flow conveys the fibers into feeding conduit 22 where the exit opening 23 of which is directed into the spinning funnel 10. The two fiber types are introduced into the spinning funnel 10 through separate openings at different locations. The space between the feed conduit 22 and the scraper blade 12, forms a first feed path into which the glass fibers 4 are fed. The feed conduit 22 provides the second feed path in which the additive fibrous material is transported to the spinning funnel 10. However, it is also sufficient that opening 23 terminates at opening (i.e., the same opening where glass fibers are introduced) so long as the additional fibrous material 16 and the glass fibers 4 are separately introduced into spinning funnel 10 in the absence of prior admixture. The air flow 21 which has conveyed the additive fibrous material through the feed conduit 22 reinforces the drum-wind in spinning funnel 10. The glass fibers and the fibers of the additive fibrous material are intimately mixed within spinning funnel 10 so that a homogeneous composite fibrous strand structure is formed. The fibers are simultaneously vortexed so that in a single operation a well mixed hybrid yarn is produced which can be withdrawn as fiber composite 14.

On the fiber composite 14 a fiber size composition additionally can be applied. Also a compaction apparatus optionally can be utilized (not shown). The compaction apparatus can lead to a more dense structure.

The fiber composite 14 can be passed about a guide roll 24. Subsequently, it can be wound in a package on spool 26.

During the combination of the fibrous strand components of the composite 14 the air flow from blower 20 is controlled to yield the desired homogeneous fiber admixture. The stronger the air flow, the stronger is the air vortex in the spinning funnel 10. The relative quantity of additive fibrous material in the resulting composite fibrous strand is capable of being varied through the adjustment of air flow from blower 20.

Instead of the polymeric additive fibrous material 16 identified here, other additive materials similarly can be employed, so long as they are present in the form of staple fibers of limited length. It is also possible to allow a plurality additive fibrous materials to enter the spinning funnel 10 each through an individual entry device.

The resulting composite fibrous strand is a homogeneous mixture of staple glass fibers and polymeric staple fibers. In cross section each of the fiber types is homogeneously distributed. The overall titer is in the range of approximately 20 to 5,000 tex (i.e., a denier of 180 to 45,000) and preferably 200 to 2,000 tex (i.e., a denier of 1,800 to 18,000). The weight ratio of glass fiber to fibers of additive fibrous material is 10:90 to 99:1, and preferably 10:90 to 90:10 (i.e., 10 to 90 percent by weight glass fibers and 90 to 10 percent by weight additive fibrous material).

The staple glass fibers can be formed of C-glass, E-glass, or a mixture of C-glass and E-glass. The staple glass fibers commonly possess a diameter of 2 to 25 $\mu$m and preferably 7 to 17 $\mu$m. The additive fibrous material preferably is formed from a polymeric fibrous material that is capable of being melt spun and possesses a length of more than about 10 mm, and preferably a length in the range of approximately 40 to 80 mm.

Although the invention has been described with a preferred embodiment, it is to be understood that variations and modifications may be resorted to as will be apparent to those skilled in the art. Such variations and modifications are to be considered within the scope and purview of the claims appended hereto.

We claim:

1. An apparatus for forming a composite fibrous strand comprising glass fibers and at least one additive fibrous material having enhanced homogeneity, said apparatus comprising:

a rotating surface for transporting said glass fibers;

a device for lifting said glass fibers from said rotating surface;

a spinning funnel having a circumferential wall having a longitudinal opening into which glass fibers are introduced along a first feed path, the spinning funnel having an exit opening at an end thereof for removing product;

a feeding system defining a second feed path for introducing into said spinning funnel said additive fibrous material, said second feed path being separate from said first feed path when introduced into said spinning funnel; and a device for removing the resulting composite fibrous material formed in said spinning funnel.

2. An apparatus according to claim 1 wherein said first feed path and said second feed path are separated by a partitioning wall.

3. An apparatus according to claim 1 wherein said feeding system defining a second feed path includes a feeding conduit provided with a device to produce an air supply.

4. An apparatus according to claim 3 wherein said device to produce an air supply is adjustable.

5. An apparatus according to claim 3 wherein said feeding system defining a second feed path includes a device to facilitate disassociation of said additive fibrous material prior to introduction into said feeding conduit.

6. An apparatus according to claim 5 which includes a device to create air flow to facilitate said disassociation.

* * * * *